US007458645B2

(12) United States Patent
Hall et al.

(10) Patent No.: US 7,458,645 B2
(45) Date of Patent: Dec. 2, 2008

(54) MILLING MACHINE WITH CLEANING MOLDBOARD

(76) Inventors: David R. Hall, 2185 S. Larsen Pkwy., Provo, UT (US) 84606; David Wahiquist, 2185 S. Larsen Pkwy., Provo, UT (US) 84606; Timothy C. Duke, 2185 S. Larsen Pkwy., Provo, UT (US) 84606; Joe Fox, 2185 S. Larsen Pkwy., Provo, UT (US) 84606; Tyson J. Wilde, 2185 S. Larsen Pkwy., Provo, UT (US) 84606

( * ) Notice: Subject to any disclaimer, the term of this patent is extended or adjusted under 35 U.S.C. 154(b) by 145 days.

(21) Appl. No.: 11/566,151

(22) Filed: Dec. 1, 2006

(65) Prior Publication Data

US 2008/0129103 A1 Jun. 5, 2008

(51) Int. Cl.
*E01C 23/12* (2006.01)

(52) U.S. Cl. ..... 299/39.2; 299/81.2

(58) Field of Classification Search ..... 299/1.5, 299/1.9, 39.2, 81.2; 405/90
See application file for complete search history.

(56) References Cited

U.S. PATENT DOCUMENTS 4,041,623 A * 8/1977 Miller et al. ..... 299/39.8
4,139,318 A 2/1979 Jakob
4,325,580 A * 4/1982 Swisher et al. ..... 299/39.8
4,793,730 A 12/1988 Butch
4,827,559 A 5/1989 Norland
5,078,540 A 1/1992 Jakob
5,505,598 A 4/1996 Murray
5,794,854 A 8/1998 Yie
6,733,086 B1 5/2004 McSharry

* cited by examiner

*Primary Examiner*—John Kreck
(74) *Attorney, Agent, or Firm*—Tyson J. Wilde

(57) ABSTRACT

In one aspect of the invention, a system for removing a layer of a paved surface includes a vehicle adapted to traverse a paved surface in a selected direction. A milling drum attached to the vehicle may be adapted to rotate around an axle substantially normal the selected direction of the vehicle. A moldboard may be positioned rearward of the milling drum and also connected to the vehicle. The moldboard may comprise an end that is adapted to push aggregate removed from the paved surface in the selected direction. A plurality of nozzles may be disposed proximate the end of the moldboard which may also be in communication with a fluid reservoir through a fluid pathway.

20 Claims, 11 Drawing Sheets

MILLING MACHINE WITH CLEANING MOLDBOARD

BACKGROUND OF THE INVENTION

The present invention relates to milling machines that are used in road surface repairs. Milling machines are typically utilized to remove a layer or layers of old or defective road surface in preparation for resurfacing. Resurfacing an existing road surface with such defects may result in a perpetuation of prior existing conditions, especially if the road surface is exposed to heavy and/or continuous traffic which often requires the road to be resurfaced again within a short period of time. Milling may also provide a renewable source of aggregate such as recycled asphalt that may be used to resurface milled surfaces.

Typically the milling machines direct milled road fragments towards a conveyer which takes the fragments off the road, however, a significant amount of debris, aggregate, and fragments remain on the milled surface. When using asphalt or other pavement material to resurface a road the milled surface must be substantially clean of any residue material before a new layer can be deposited. Failure to clear the milled surface of such material may result in poor bonding between the new asphalt and the milled surface. Typically a sweeper will come along after the milling machine to remove of the debris, but often this is inefficient and uneconomical.

U.S. Pat. No. 4,139,318 by Jakob et al., which is herein incorporated by reference for all that it contains, discloses a method and apparatus for planning a paved roadway wherein a main frame is drivingly supported by track assemblies and a planer assembly is disposed in cutting engagement with a top portion of the pave roadway to produce a new roadway surface.

U.S. Pat. No. 4,793,730 by Butch, which is herein incorporated by reference for all that it contains, discloses a method and apparatus for renewing the surface of asphaltic paving at low cost and for immediate reuse.

U.S. Pat. No. 5,505,598 by Murray, which is herein incorporated by reference for all that it contains, discloses a modification of a cold milling machine used to remove concrete and asphalt from an existing highway is disclosed, including a milling drum segmented into two or more sections with the drive train for the milling drums passing through the core of the milling drum and supported via a journal or bearing to the outside of the machine.

U.S. Pat. No. 6,733,086 by McSharry et al., which is herein incorporated by reference for all that it contains, discloses a vacuum system mounted on a portable milling machine for extracting material cut by the milling drum of the machine from the surface of a roadway.

BRIEF SUMMARY OF THE INVENTION

The present invention comprises a system for removing a layer of a paved surface. The system may comprise a vehicle adapted to traverse a paved surface in a selected direction. A milling drum may be adapted to rotate around an axle substantially normal the selected direction of the vehicle. The milling drum may be orientated vertically or horizontally with respect the vehicle. In one aspect of the invention a moldboard may be positioned rearward of the milling drum and also connected to the vehicle. The moldboard may comprise an end that is adapted to push aggregate removed from the paved surface in the selected direction. A plurality of nozzles may be disposed proximate the end of the moldboard which may also be in communication with a fluid reservoir through a fluid pathway.

The plurality of nozzles may be utilized to provide fluid that effectively pushes aggregate towards the milling drum while at the same time substantially reducing any dust particles from forming. The fluid from the reservoir may also be utilized through the fluid pathway to reduce friction, absorb heat and remove any aggregate from the milling drum that may begin to build up when the milling drum is engaging the paved surface. As a result the milled surface may be substantially void of any residue material and promote better bonding for resurfacing.

DETAILED DESCRIPTION OF THE INVENTION AND THE PREFERRED EMBODIMENT

Figure 1:
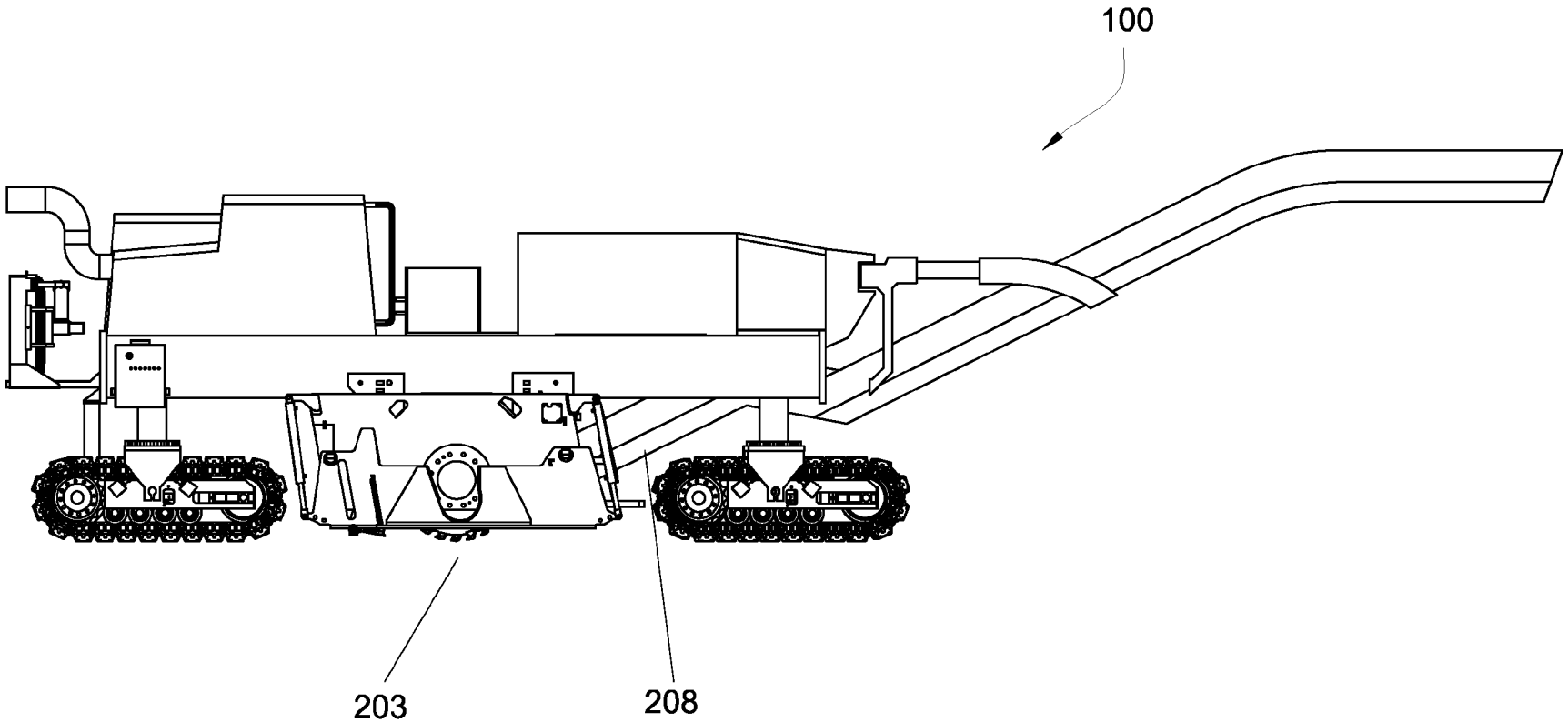
FIG. 1 is a perspective diagram of an embodiment of a milling machine.

FIG. 1 depicts a milling machine 100 which may be used to remove asphalt from road surfaces. A milling drum 203 is attached to the underside of the frame of the milling machine 100. A conveyer 208 is adapted to take the millings off the road. Typically the millings are loaded into a bed of a truck (not shown) where the millings may be hauled away.

Figure 2:
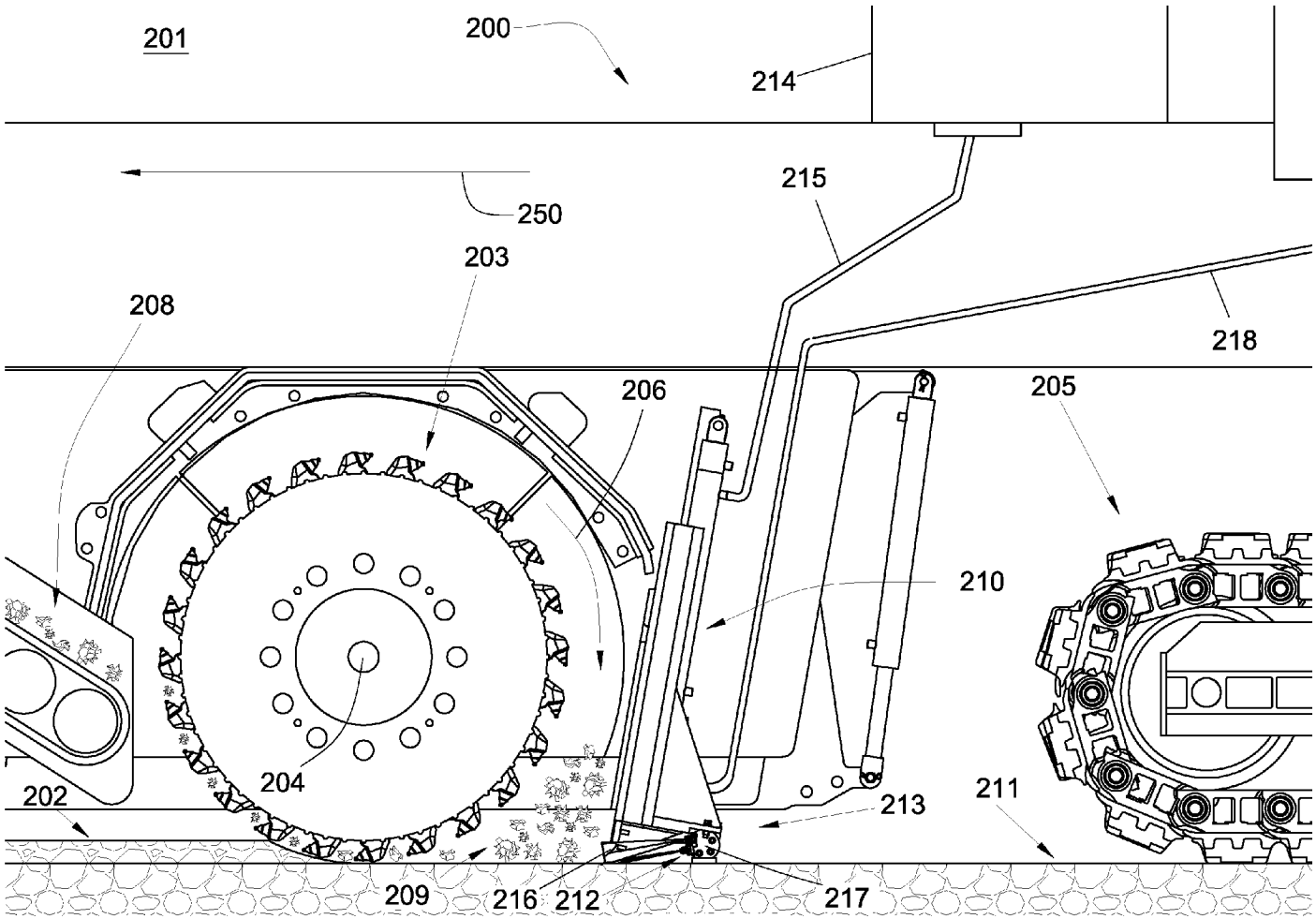
FIG. 2 is another perspective diagram of an embodiment of a milling machine.

FIG. 2 is a perspective diagram of an embodiment of the current invention, specifically a system 200 for removing a layer of paved surface. The system 200 may comprise a vehicle 201 adapted to traverse a paved surface 202 in a selected direction depicted by arrow 250 with a milling drum 203 comprising an axle 204 connected to the vehicle 201. In the current embodiment the vehicle 201 comprises tracks, but in other embodiments rubber wheels may be utilized. The milling drum 203 may also be adapted to rotate around the axle 204 substantially normal to the selected direction. In some embodiments the milling drum 203 may be rotated in a clockwise direction depicted by arrow 206, by a means which may include an internal combustion engine (not shown). A conveyer belt 208 may be positioned adjacent the milling drum 203 and adapted to remove a portion of the aggregate 209. The loose aggregate 209 may then be deposited into a collecting vehicle (not shown) that may follow in front, rear or side of the milling machine 100.

A significant feature of the present invention is a moldboard 210 connected to the vehicle 201 that may be positioned rearward of the milling drum 203. The moldboard 210 may provide a means of substantially removing any remaining loose aggregate or debris that has not been captured by the milling drum 203 in order to prepare the milled surface for paving. The moldboard 210 may comprise an end that is adapted to push aggregate 209 removed from the paved surface 202 in a selected direction In some embodiments the aggregate 209 may be pushed towards the milling drum 203. A plurality of nozzles 212 may be disposed proximate the end 213 of the moldboard 210 and be in communication with a fluid reservoir 214 through a fluid pathway 215. The end 213 may comprise a leading edge 216 that is adapted to engage the loose aggregate and/or debris. The end 213 may also comprise a rear portion 217 disposed generally rearward the leading edge. An exhaust system 218 may run adjacent to the fluid path 215 such that the heat from the exhaust may be used to heat the fluid in the fluid path 215. The plurality of nozzles 212 may be disposed rearward of the moldboard 210 and adapted to direct fluid underneath the moldboard 210 and towards the milling drum 203. The fluid may comprise hot fluid, steam, cold fluid, water, polymers, synthetic clay, surfactants, binding agents, or combinations thereof depending on the type of application that the system 200 is being engaged in. In some embodiments the kinetic energy resulting from the fluid being ejected from the nozzles 212 may help to push aggregate towards the milling drum 203 and prevent any loose aggregate 209 from traversing under the moldboard 210. In other embodiments the chemical composition of the fluid may be used to provide a substantially cleaner milled surface 211 for resurfacing. In some embodiments the fluid from the nozzles 212 may also provide a means of substantially reducing dust particles from forming and interfering with resurfacing. The fluid from the nozzles 212 may also assist to reduce friction by absorbing heat and dissolving aggregate 209 that may begin to build up on the milling drum 203 when engaging the paved surface 202.

Figure 3:
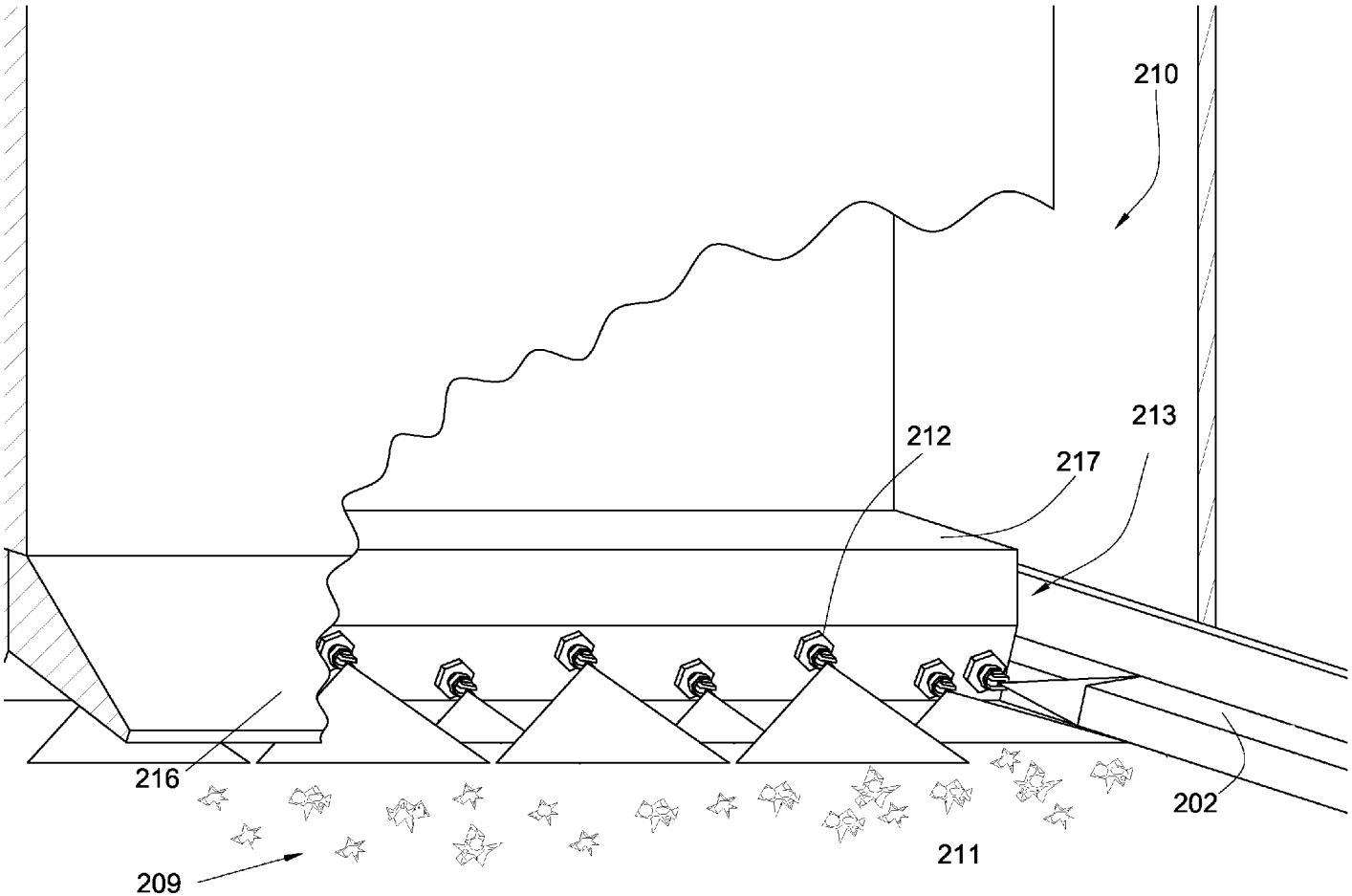
FIG. 3 is a perspective diagram of an embodiment of a plurality of nozzles.

FIG. 3 is a diagram of an embodiment of the plurality of nozzles 212 that may be disposed within the rear portion 217 of the distal end 213 of the moldboard 210. The diagram depicts the moldboard 210 being engaged within a depth of cut of the paved surface 202. The current embodiment discloses how at least one of the plurality of nozzles 212 may be offset at least 0.25 inches. Since the nozzles in the embodiment of FIG. 3 produce a fanned stream of fluid, the offset between the nozzles prevents the fanned streams from interacting with each other. The offset nozzles 212 may provide a more effective means of pushing any loose aggregate 209 or debris towards the milling drum 203 by providing a continuous stream of fluid across the entire width of the milled surface 211. In some embodiments the nozzles 212 may substantially prevent any loose aggregate 209 or debris from traversing under the leading edge 216 of the moldboard 210 leaving a substantially cleaner milled surface 211.

Figure 4:
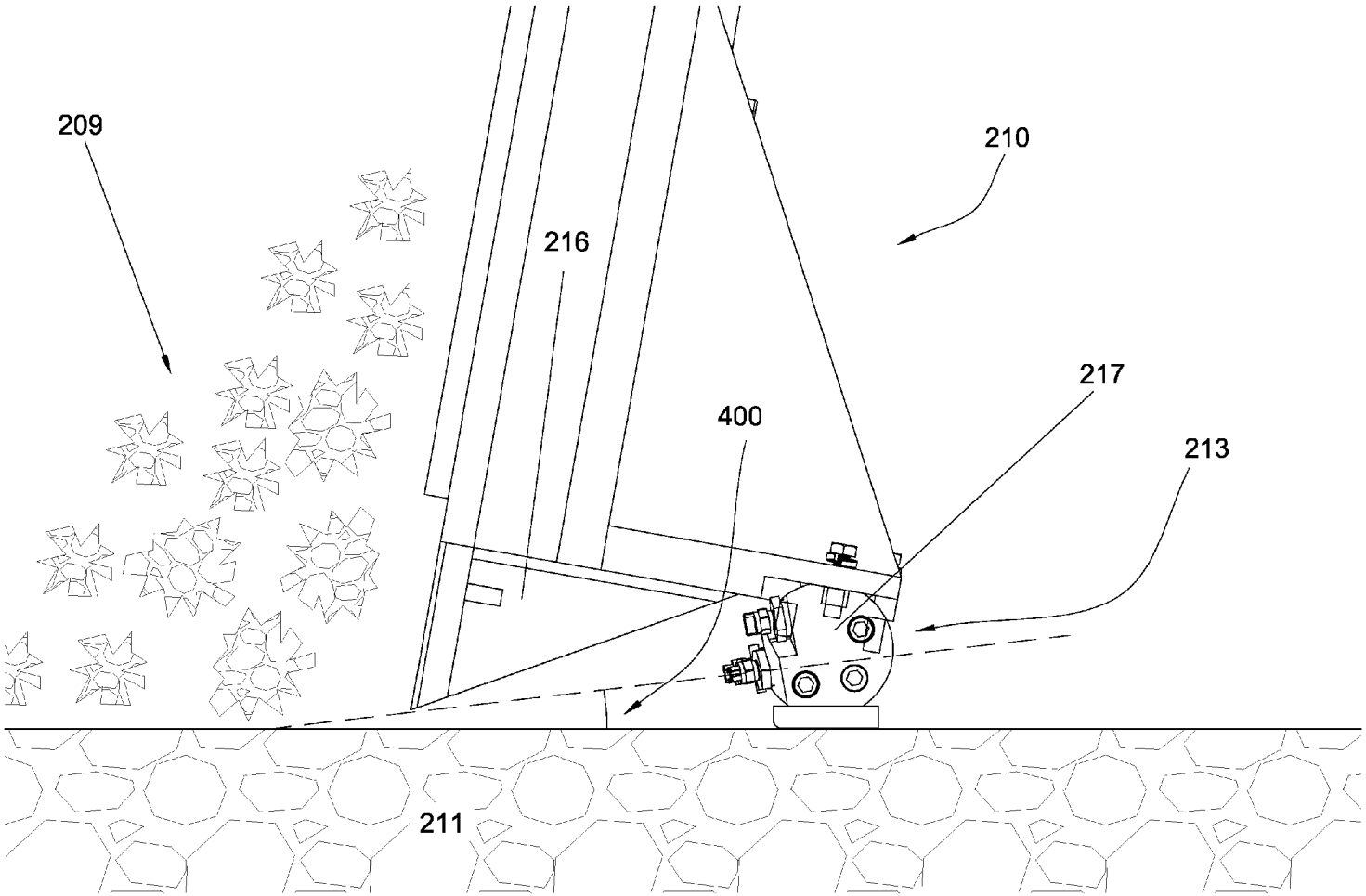
FIG. 4 is a perspective diagram of an embodiment of a moldboard.

FIG. 4 is a diagram of an embodiment of the moldboard 210 comprising a proximate end 213 with a plurality of nozzles 212 that may be positioned to direct a stream of fluid forming an angle 400 less than 45 degrees with the milled surface 211. In some embodiments the angle 400 at which the nozzles are positioned may be critical in minimizing the effect of back spray which could cause the nozzles 212 to become blocked with debris. The angle 400 may also be critical in helping to maintain sufficient pressure to adequately prevent loose aggregate 209 from traversing under the leading edge 216 of the moldboard 210.

Figure 5:
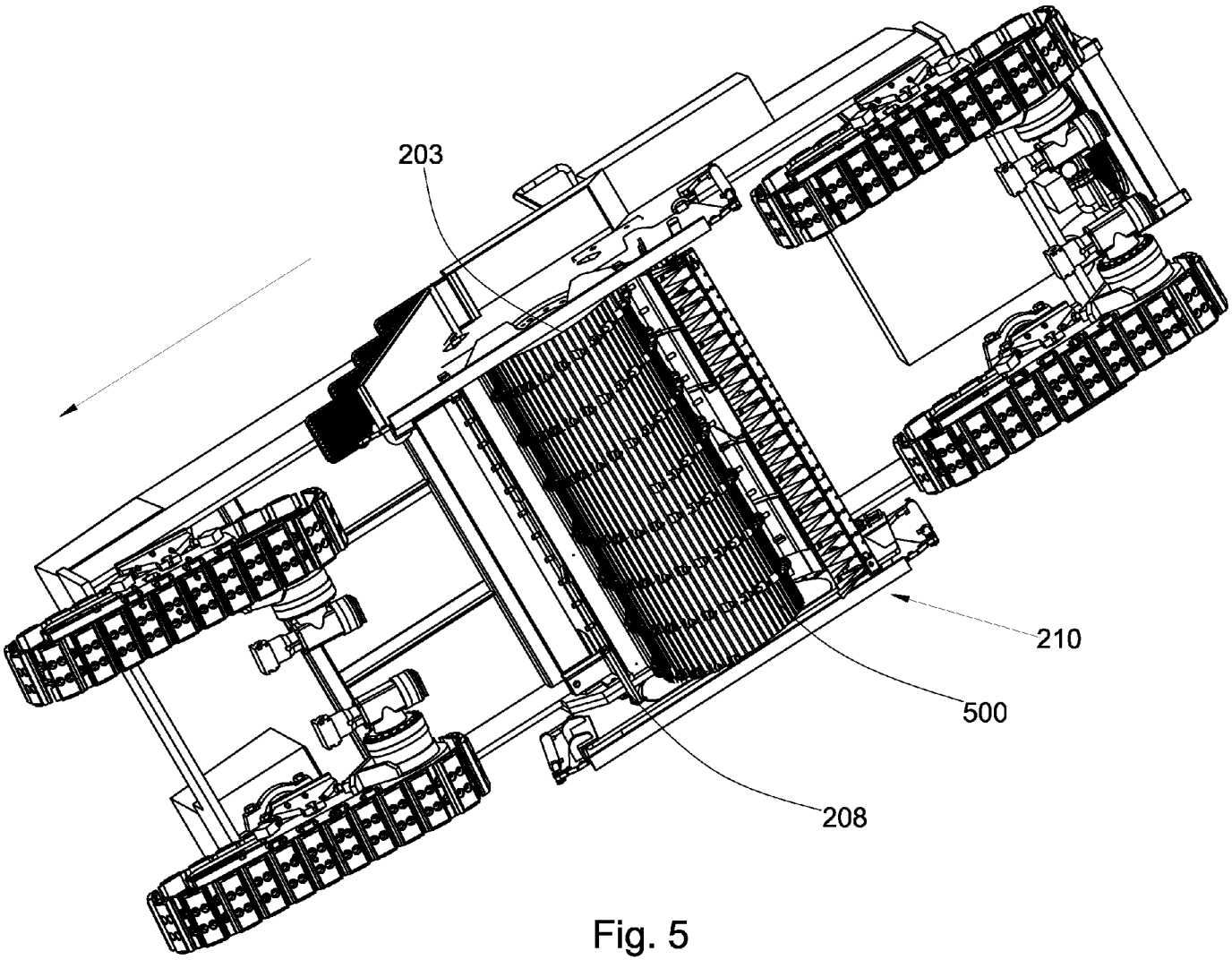
FIG. 5 is a perspective diagram of another embodiment of a milling machine.

FIG. 5 is a diagram of another embodiment of the system 200 wherein the milling drum 203 may comprise a plurality of helically spaced teeth 500 adapted to degrade the paved surface 202 and direct aggregate 209 laterally towards the center of the milling drum 203. The aggregate 209 may then be subsequently directed towards a conveyer belt 208 for removal. In this embodiment the helical arrangement may be utilized to contain the loose aggregate 209 or debris and help to prevent the material from being diffused on either side of the milling drum 203. The plurality of helical arranged teeth 500 may be used to remove the majority of millings.

Figure 6:
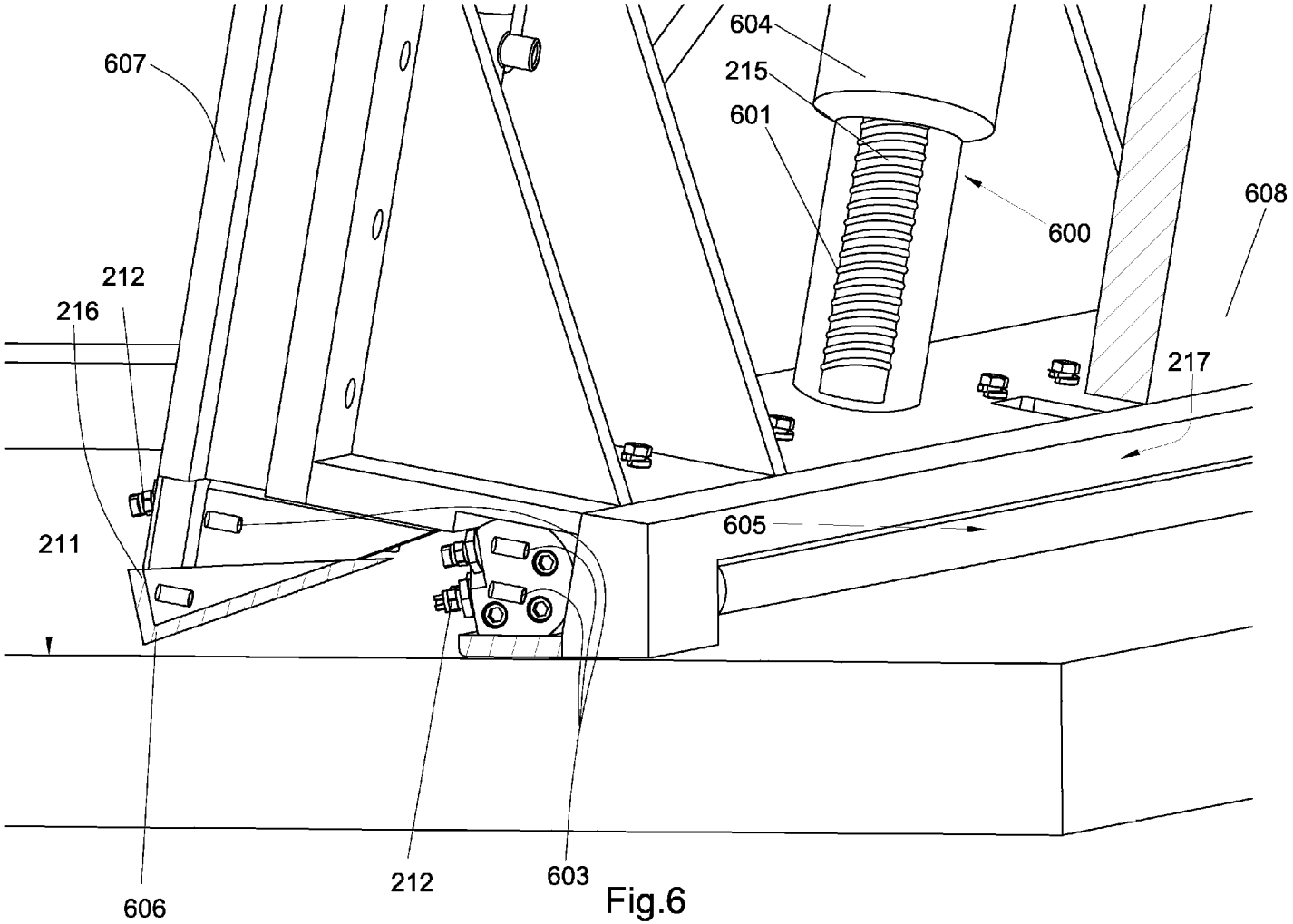
FIG. 6 is a perspective diagram of another embodiment of a moldboard.

FIG. 6 is a diagram of another embodiment of a moldboard 210 comprising a front panel 607 and a rear panel 608 wherein at least a portion of the fluid pathway 215 may be supported by the moldboard 210 with at least a portion of the fluid pathway 215 being formed in the moldboard 210. A heat exchanger 600 may also be adapted to heat fluid that passes through the fluid pathway 215 wherein the heat exchanger 600 may comprise a heat source comprising a portion of the exhaust produced by the vehicle 201. In the current embodiment the heat exchanger 600 may also comprise a heating element 601 coiled around the fluid path 215. The heated fluid may promote a higher rate of evaporation than non-heated fluid and may aid to dissolve any remaining residue leaving a substantially dryer, cleaner milled surface 211. In some embodiments, the heated fluid may turn to steam as it exits through the nozzles. This may be advantageous since the steam prevents the fluid from pooling on the road. The moldboard 210 may also comprise sensors 603 disposed within the distal end 213 selected from the group consisting of moisture sensors, temperature sensors, pressure sensors, optical sensors or combinations thereof. In some embodiments the sensors 603 may be part of a closed loop system which may automatically adjust parameters of the moldboard 210 or other components of the cleaning system, such as the pressure or heat of the fluid.

A pump 604 may be disposed along the fluid pathway 215 and adapted to pressurize fluid in the pathway. The pressurized fluid may be ejected from the nozzles 212 at a high rate of velocity and assist to move loose aggregate 209 and or debris more effectively in a selected direction In some embodiments the pump 604 may be in communication with a pressure sensor adapted to give feedback to the pump so that fluid pressure may be adjusted as needed. In some embodiments a nozzle 212 may also be disposed in the leading edge 216 adapted to direct fluid in front of the moldboard 210 which may assist to push loose aggregate towards the milling drum 203 while subsequently helping to cool the milling drum 203. A heater 605 may be positioned rearward of at least one of the nozzles 212 within the rear portion 217 of the moldboard 210 being slightly recessed above the milled surface. In some embodiments the heater 605 may be in communication with a moisture sensor used to monitor the level of residue fluid and to activate the heater if the moisture levels are too high. The heater may assist in further evaporating any pooled fluid left behind as the moldboard 210 traverses the milled surface 211. In yet other embodiments the heater may also incorporate a blower component that is utilized to force heated air towards the milled surface to assist in evaporating fluid. The moldboard 210 may further comprise a wear resistant material 606 comprising a hardness of at least 63 HRc which may be disposed on the under side of the leading edge 216. The wear resistant material 606 may significantly reduce wear on portions of the leading edge 216 that are in continuous or close contact with the milled surface 211 and or aggregate 209 which may cause the proximate end 213 of the moldboard 210 to deteriorate. In some embodiments the wear resistant material 606 may comprise polycrystalline diamond however the wear resistant material 606 may also comprise a material selected from the following consisting of natural diamond, synthetic diamond, single crystalline diamond, cubic boron nitrate, vapor deposited diamond, chromium, stellite, titanium, nitride, manganese, aluminum, carbide, tungsten, niobium, silicon, or combinations thereof.

Figure 7:
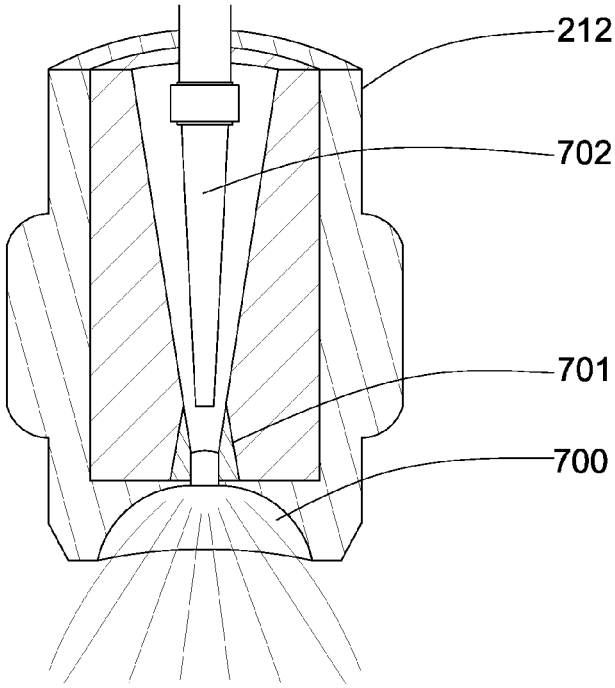
FIG. 7 is a cross sectional diagram of an embodiment of a nozzle.
Figure 8:
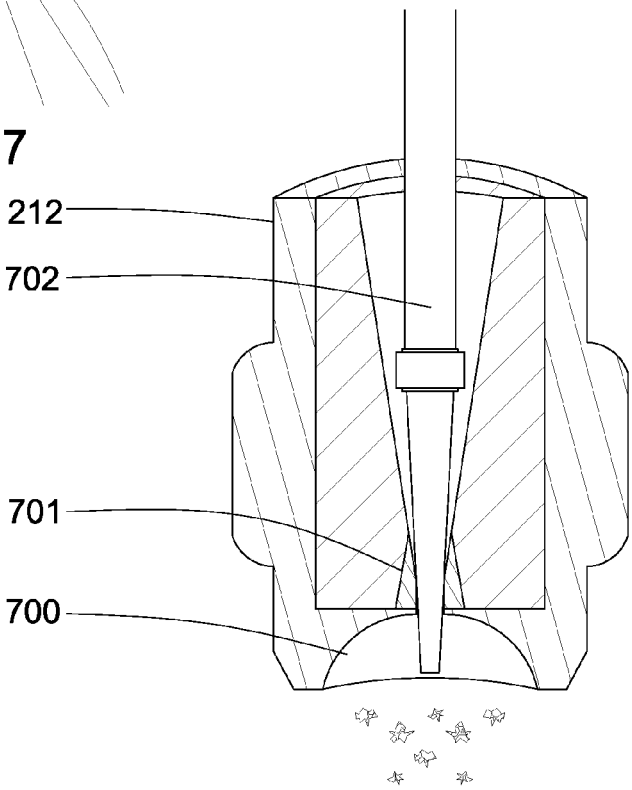
FIG. 8 is a cross sectional diagram of another embodiment of a nozzle.

FIG. 7 is a diagram of an embodiment of a nozzle 212 adjacent an expansion chamber 700. The nozzle 212 may comprise a material 701 with a hardness greater than 62 HRc that is utilized to reduce wear caused as fluid is forced through the nozzle 212 and out through the expansion chamber 700. In some embodiments the nozzle 212 may comprise a stem 702 that is included in a closed loop system that may be activated in the event that the nozzle 212 becomes blocked or the fluid is to be redirected to another nozzle 212. FIG. 8 is a diagram of an embodiment of a nozzle 212 wherein the stem 702 is positioned such that it substantially blocks the fluid from exiting the nozzle. The stem 702 may be used to clean the nozzle by pushing away debris clogged in the nozzle. In other embodiments, the stem 702 may be used to redirect the fluid so that it exits an adjacent nozzle, which may provide the benefit of building up pressure behind a clogged nozzle until the debris is ejected out of it.

Figure 9:
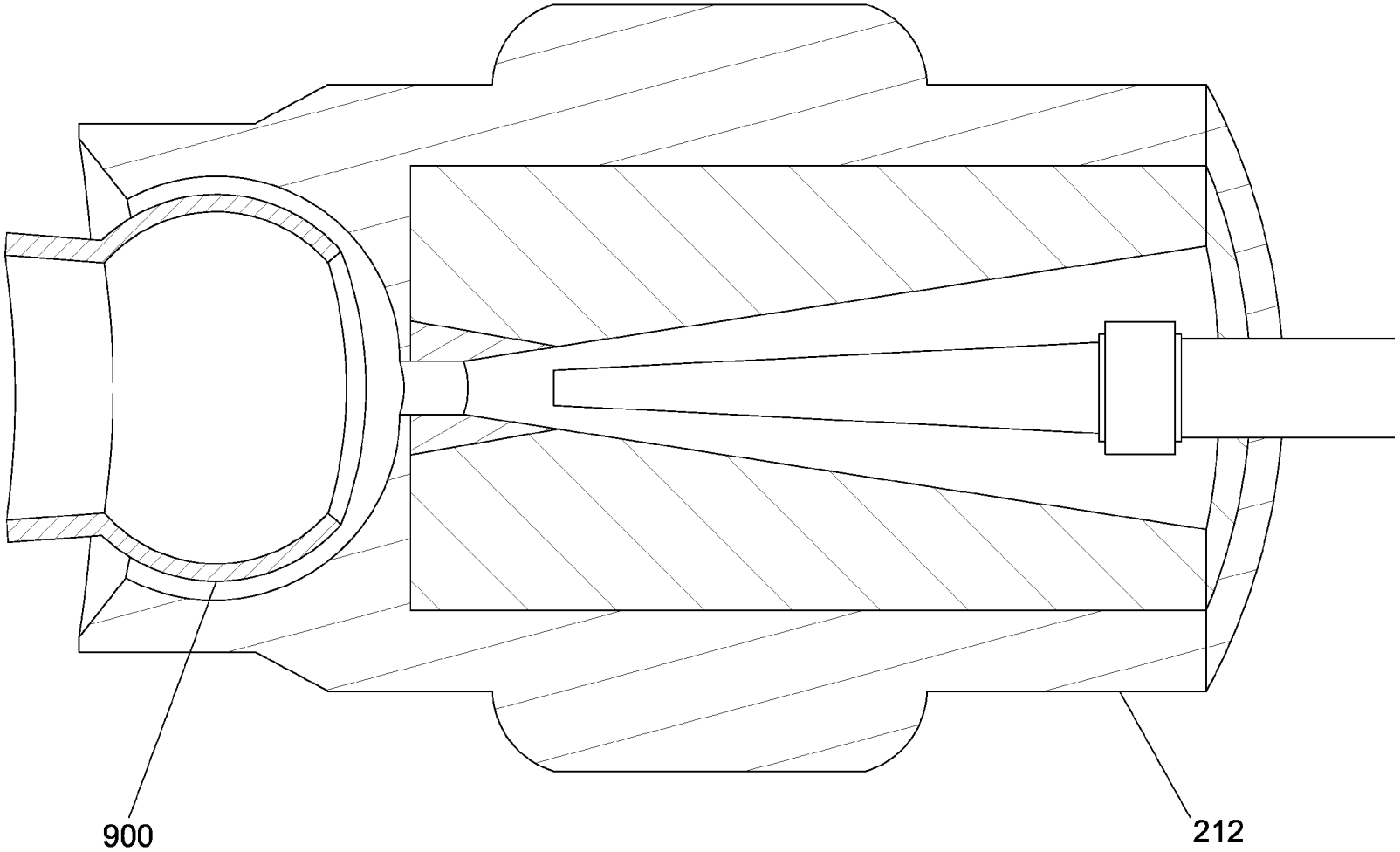
FIG. 9 is a cross sectional diagram of another embodiment of a nozzle.

FIG. 9 is a diagram of another embodiment of a nozzle 212 comprising a directional expansion chamber 900. The directional expansion chamber 900 may pivot, thereby changing the direction of the fluid flow. The redirected fluid flow may be used to when adjacent nozzles are clogged or shut off so that all of the debris is still prevented from getting under the moldboard. In some embodiments the directional expansion chamber 900 may be in communication with a sensor 603 that may be utilized to redirect the stream of fluid in a selected direction.

Figure 10:
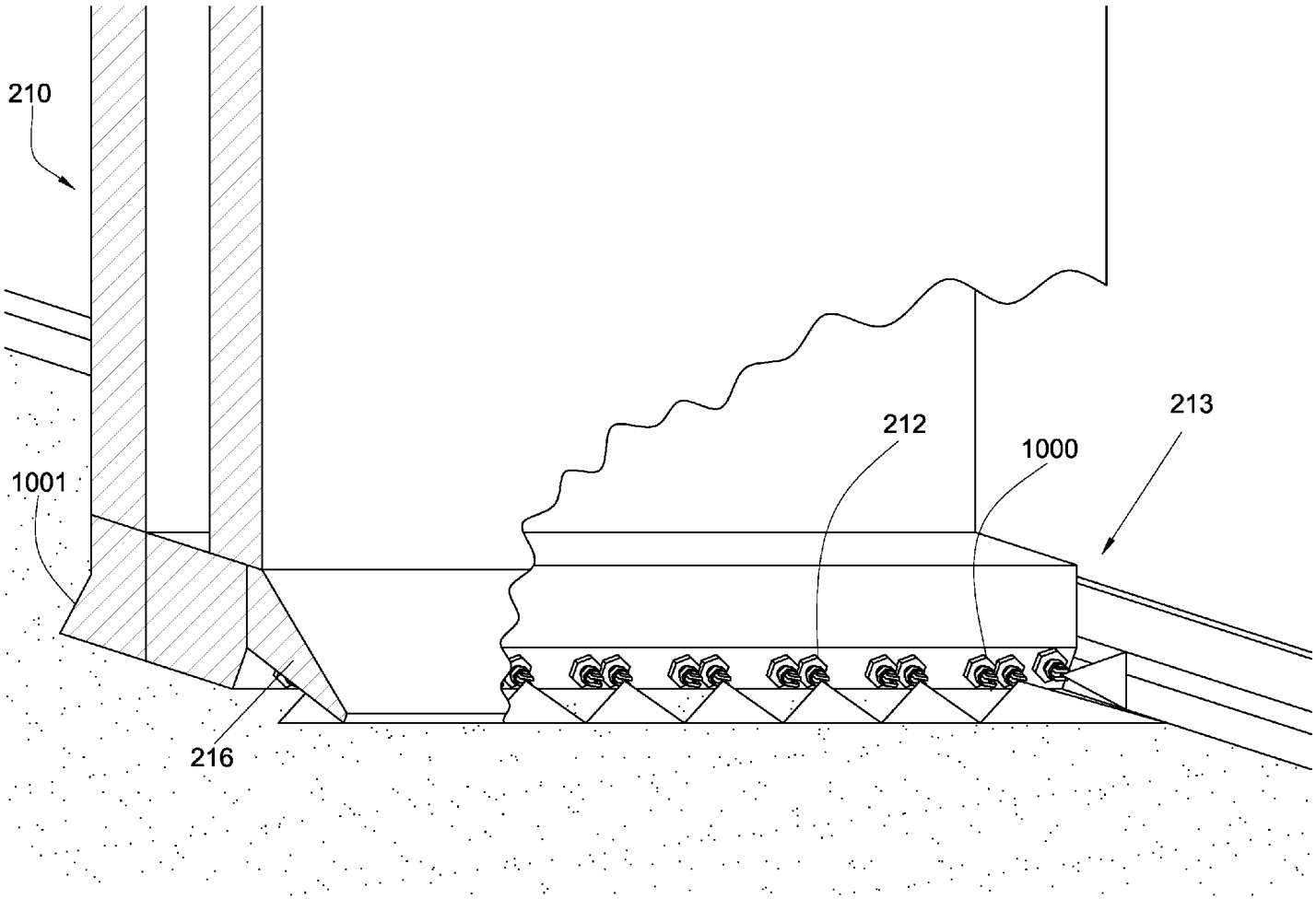
FIG. 10 is a perspective diagram of another embodiment of a plurality of nozzles.

FIG. 10 is a diagram of an embodiment of the proximate end 213 comprising at least one backup nozzle 1000. The backup nozzle 1000 may be in communication with a sensor 603 in a closed loop system that is utilized to monitor when a nozzle 212 is not working properly. The sensor 603 may also be utilized to activate the backup nozzle 1000 to direct fluid in a selected direction to compensate for a nozzle that isn't working, such as a nozzle that is substantially blocked. In some embodiments the backup nozzles 1000 may ensure that a constant stream of fluid is being applied to substantially push any aggregate 209 or debris in front of the moldboard 210. In some embodiments the backup nozzles 1000 may also be activated to engage larger pieces of loose aggregate 209 that may require more pressure to move them effectively. A vacuum 1001 may be disposed generally rearward the proximate end 213 such that it trails behind the moldboard 210 and proximate the milled surface 211. The vacuum 1001 may be incorporated to remove any remaining residue not already removed by the leading edge 216 or plurality of nozzles 212.

Figure 11:
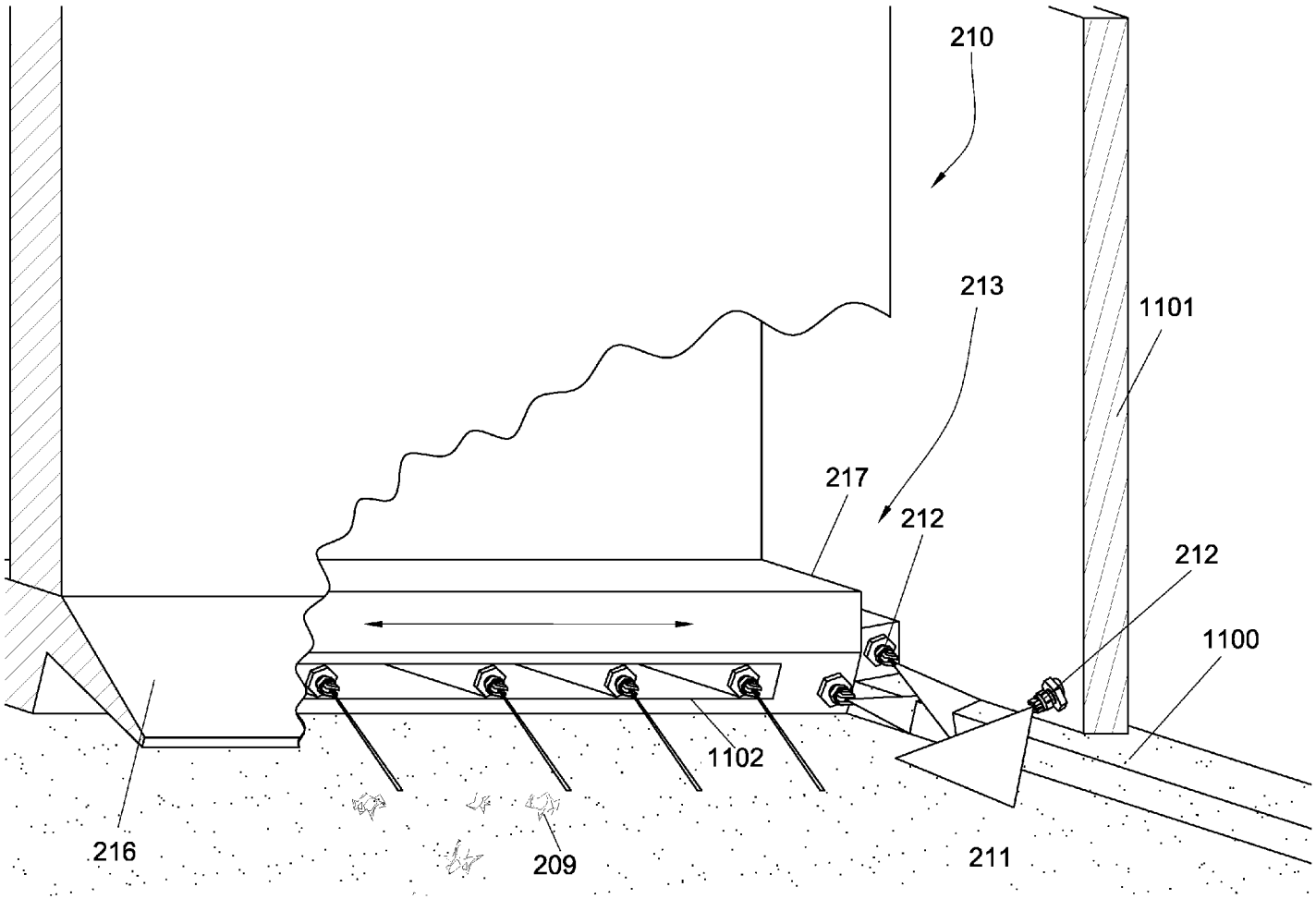
FIG. 11 is a perspective diagram of another embodiment of a plurality of nozzles.

FIG. 11 is a diagram of another embodiment of the moldboard 210 depicting at least one of the plurality of nozzles 212 that may be adapted to push aggregate 209 away from a sidewall 1100 formed by the milling drum's depth of cut. Another nozzle 212 may be disposed within a side board 1101 positioned adjacent the milling drum 203 and adapted to direct loose aggregate 209 generally towards the milling drum 203. The nozzles 212 may be positioned to provide a stream of fluid that may assist to contain any loose aggregate or debris and prevent it from collecting towards the side boards 1101 by redirecting it towards the milling drum 203. The plurality of nozzles 212 may also be disposed within a slot 1102 formed in the distal end 213 of the moldboard 210 where the slot is utilized to house the plurality of nozzles 212 and provide a structure wherein the nozzles may be utilized to oscillate in a selected direction.

Figure 12:
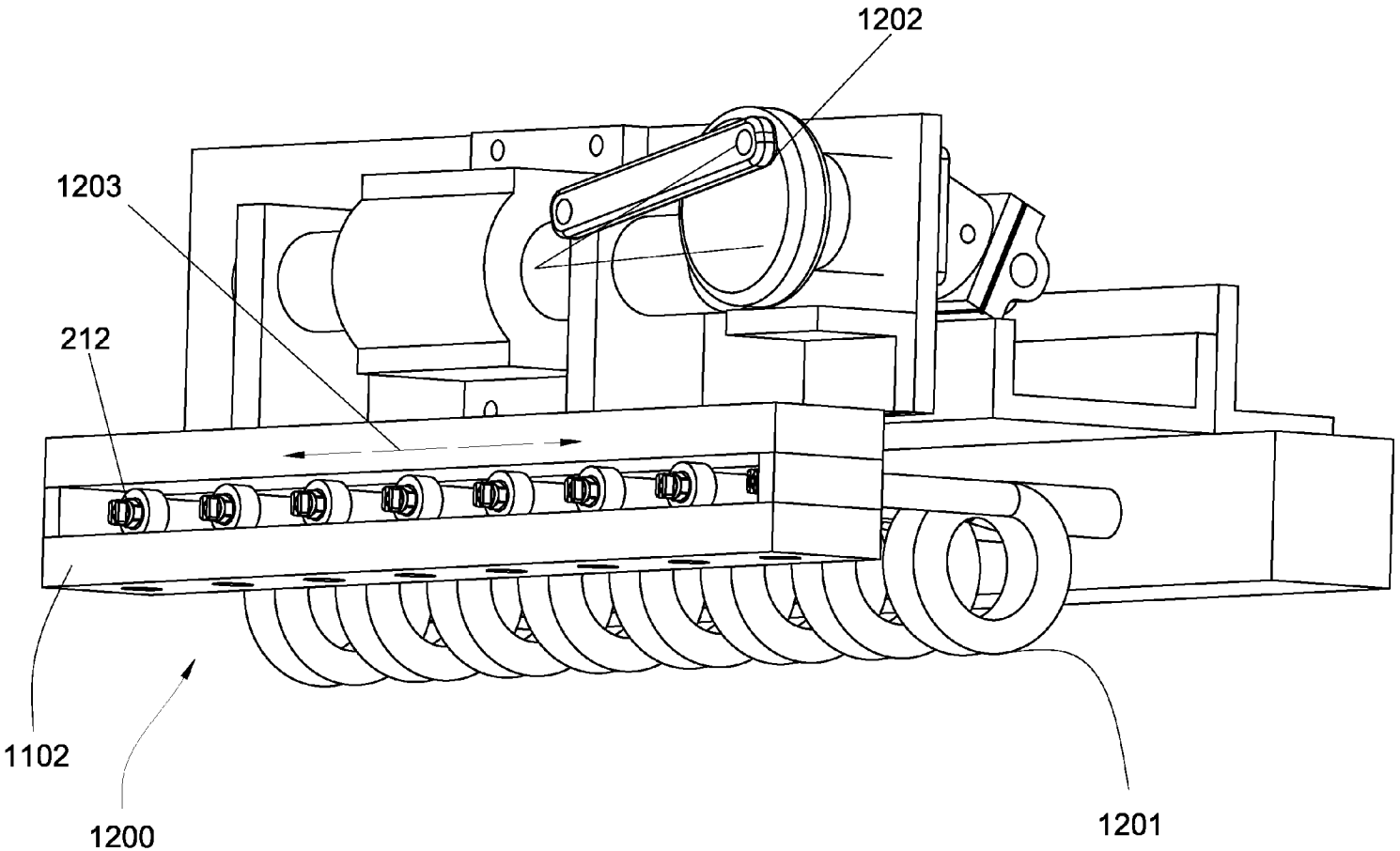
FIG. 12 is a perspective diagram of another embodiment of a plurality of nozzles.

FIG. 12 is an perspective diagram of another embodiment of the plurality of nozzles 212 which provide a straight stream of fluid, which may oscillate laterally at least 0.25 inches while disposed within a slot 1102 disposed within the moldboard. The straight nozzles 1200 may comprise a generally coiled portion 1201 that may provide an element of elasticity allowing the straight nozzles 1200 to have a range of motion and to be manipulated in a selected direction. The straight nozzles 1200 may further be connected collectively as a single unit to a cam mechanism 1202 which may provide the linear motion 1203 required to move the straight nozzles 1200. In some embodiments the oscillation may allow all of the aggregate 209 or other material to be directed towards the milling drum (not shown). An advantage of having a straight stream of fluid is the concentration of fluid directed at a single location all at once allowing for maximum kinetic energy to remove the millings. The oscillation of the nozzles allows a wider surface area of the milled surface to be cleaned by the straight streams. This may enable the system to operate without having to manipulate the direction or spray pattern of the straight nozzles 1200.

Whereas the present invention has been described in particular relation to the drawings attached hereto, it should be understood that other and further modifications apart from those shown or suggested herein, may be made within the scope and spirit of the present invention.

What is claimed is:

1. A system for removing a layer of a paved surface, comprising:

a vehicle adapted to traverse a paved surface in a selected direction;

a milling drum with an axle connected to the vehicle, the drum being adapted to rotate around the axle substantially normal the selected direction;

a moldboard positioned rearward of the milling drum and also connected to the vehicle;

the moldboard comprises an end that is adapted to push aggregate removed from the paved surface in the selected direction; and a plurality of nozzles is disposed proximate the end of the moldboard and is in communication with a fluid reservoir through a fluid pathway, wherein the plurality of nozzles are adapted to direct a portion of the aggregate generally in the selected direction by ejecting a fluid generally in the selected direction.

2. The system of claim 1, wherein a heat exchanger is adapted to heat fluid that passes through the fluid pathway.

3. The system of claim 2, wherein the heat exchanger comprises a heat source comprising a portion of exhaust produced by the vehicle.

4. The system of claim 1, wherein the moldboard comprises sensors disposed within the proximate end selected from the group consisting of moisture sensors, temperature sensors, optical sensors, pressure sensors or combinations thereof.

5. The system of claim 1, wherein the moldboard comprises a plurality of nozzles which are adapted to direct loose aggregate towards a central portion of the milling drum.

6. The system of claim 1, wherein an expansion chamber is positioned adjacent the nozzle.

7. The system of claim 1, wherein a nozzle is disposed within a side board positioned adjacent the milling drum and adapted to direct loose aggregate.

8. The system of claim 1, wherein a heater is positioned rearward of at least one of the nozzles.

9. The system of claim 1, wherein a conveyer belt is positioned adjacent the milling drum and adapted to remove a portion of the aggregate.

10. The system of claim 1, wherein at least a portion of the fluid pathway is supported by the moldboard.

11. The system of claim 1, wherein at least a portion of the fluid pathway is formed in the moldboard.

12. The system of claim 1, wherein at least one of the plurality of nozzles is positioned rearward of the moldboard and adapted to direct a fluid underneath the moldboard.

13. The system of claim 1, wherein a nozzle is disposed in a front portion of the moldboard and adapted to direct fluid in front of said moldboard.

14. The system of claim 1, wherein at least one of the plurality of nozzles is positioned to direct a stream of fluid, the stream substantially forming an angle less than 45 degrees with the milled surface.

15. The system of claim 1, wherein at least one of the plurality of nozzle is offset at an elevation at least 0.25 inches.

16. The system of claim 1, wherein at least one of the plurality of nozzles comprises a straight nozzle that oscillates laterally at least 0.25 inches.

17. The system of claim 1, wherein at least one of the plurality of nozzles comprises a shut off valve in communication with a closed loop system.

18. The system of claim 1, wherein at least one of the plurality of nozzles comprises a back up nozzle.

19. A method for removing a layer of a paved surface, comprising the steps of:

providing a vehicle adapted to traverse a paved surface in a selected direction;

providing a milling drum with an axle connected to the vehicle, the drum being adapted to rotate around the axle and a moldboard positioned rearward of the milling drum and also connected to the vehicle;

the moldboard comprises an end adapted to push aggregate removed from the paved surface in the selected direction and the moldboard comprising at least one nozzle in communication with a fluid reservoir through a fluid pathway and being positioned near the end;

rotating the drum against a paved surface such that a layer of the paved surface is loosened; and cleaning an exposed layer of the paved surface by directing a portion of the loosened aggregate in a generally forward direction by ejecting a fluid out of the at least one nozzle.

20. The method of claim 19, wherein the fluid comprises hot fluid, steam, cold fluid, water, polymers, synthetic clay, surfactants, binding agents, or combinations thereof.

* * * * *